United States Patent [19]

Gerlack

[11] 4,352,077

[45] Sep. 28, 1982

[54] RIDGED WAVEGUIDE WINDOW ASSEMBLY

[75] Inventor: Richard Z. Gerlack, Cupertino, Calif.

[73] Assignee: Varian Associates, Inc., Palo Alto, Calif.

[21] Appl. No.: 270,328

[22] Filed: Jun. 4, 1981

Related U.S. Application Data

[63] Continuation of Ser. No. 40,360, May 18, 1979, abandoned.

[51] Int. Cl.[3] ..... H01P 1/08

[52] U.S. Cl. ..... 333/252; 333/248

[58] Field of Search ..... 333/252

[56] References Cited

U.S. PATENT DOCUMENTS

| | | | |
|---|---|---|---|
| 2,706,275 | 4/1955 | Clark, Jr. | 333/252 X |
| 2,883,631 | 4/1959 | Blackadder et al. | 333/252 |
| 2,894,228 | 7/1959 | Geisler, Jr. | 333/252 |
| 2,932,806 | 4/1960 | Burr, Jr. | 333/252 |
| 2,939,036 | 5/1960 | Nelson | 333/252 X |
| 3,324,427 | 6/1967 | Weiss | 333/252 |
| 3,439,296 | 4/1969 | Buckley | 333/252 |
| 3,775,709 | 11/1973 | Firmain et al. | 333/252 |
| 3,860,891 | 1/1975 | Hiramatsu | 333/252 X |
| 3,936,779 | 2/1976 | Achter | 333/252 |

*Primary Examiner*—Malcolm F. Hubler

*Attorney, Agent, or Firm*—Stanley Z. Cole; Richard B. Nelson; Peter J. Sgarbossa

[57] ABSTRACT

A window assembly for ridged waveguide has a slab of dielectric extending clear across the waveguide cross-section. The slab may be perpendicular to the waveguide or cross it at an angle. The waveguide ridge or ridges are notched so that the dielectric slab passes through the notch. Inductive tuning posts may be added to make a broadband match. The window assembly has an excellent match over more than an octave frequency range.

13 Claims, 5 Drawing Figures

RIDGED WAVEGUIDE WINDOW ASSEMBLY

This is a continuation of application Ser. No. 040,360 filed May 18, 1979, now abandoned.

DESCRIPTION

FIELD OF THE INVENTION

The invention pertains to ridged waveguides which are used to carry high microwave powers over very large frequency ranges. Wave-permeable dielectric windows are needed to isolate vacuum tubes or pressurized sections of waveguide.

PRIOR ART

Much of the work with ridged waveguides has been in connection with classified military applications. A broadband window for ridged waveguide is described in U.S. Pat. No. 3,860,891 issued Jan. 14, 1975 to Yukio Hiramatsu. The cross section of the waveguide at the location of the window was reduced to a small cylinder so that the lower cutoff frequency of the section containing the high-dielectric-constant window was approximately equal to the lower cutoff of the ridged guide. This approach has the disadvantage that the smaller cross section has less power-handling capacity. The Hiramatsu patent states that this window will transmit over just one octave of frequency range. The window of the present invention is virtually without reflections over a band of considerably more than one octave.

SUMMARY OF THE INVENTION

A purpose of the invention is to provide a window assembly for ridged waveguide having good wave transmission over a frequency range greater than an octave.

A further purpose is to provide a window assembly capable of transmitting very high power.

A further purpose is to provide a window assembly that is easy to manufacture.

These purposes are achieved by a dielectric slab window extending across the entire hollow cross-section of the waveguide and passing through a notch in the ridge. Reflection-free bandwidth of over 2:1 has been measured in a completed vacuum-tight window assembly.

DESCRIPTION OF THE PREFERRED EMBODIMENTS

Figure 1A:
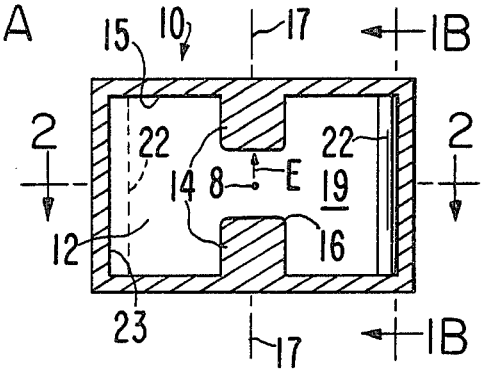
FIG. 1A is a sectional view perpendicular to the axis of a ridged waveguide window assembly embodying the invention.
Figure 1B:
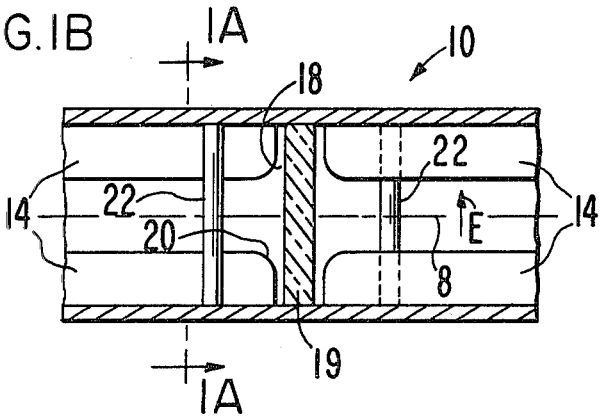
FIG. 1B is a section through the E-plane of the assembly of FIG. 1A.

FIGS. 1A and 1B are sections perpendicular to the axis 8 and parallel to the narrow wall respectively, of a window assembly embodying the invention. The waveguide 10 has a generally rectangular hollow interior 12 except for a pair of ridges 14 projecting from the broad walls 15. Ridges 14 lower the cutoff frequency of the dominant TE mode without affecting greatly the cutoffs of other spurious modes such as the horizontally polarized TE mode. Thus the useful operating frequency range of the waveguide is increased to 2 or more times that of a rectangular waveguide. The corners 16 of ridges 14 are rounded off for carrying high power without dangerous concentration of high fields at the corners. The microwave electric field E lies in a plane only for the axial plane of symmetry 17. However, other planes parallel to plane 17 are also loosely referred to a "E-planes" because in a rectangular waveguide the electric field lines are all parallel. In FIG. 1 the arrows labelled E indicate the direction of electric field at the axis of symmetry 17.

FIG. 1B is a section parallel to the narrow wall of waveguide 10. Ridges 14 are severed by notches 18 through which the dielectric window slab 19 passes. In this embodiment slab 19 extends to the extremities of the hollow interior 12, as they would be in the absence of ridges 14. Slab 19 is hermetically sealed across guide 10. In a slightly different embodiment notches 18 need not extend all the way to wide wall 15 but may only partially sever ridges 14. The severed tips 20 of ridges 14 are preferably provided with a full radius to reduce peak electric fields near window 19. Alternatively tips 20 may have a smaller radius or none at all. The basic structure of FIG. 1 generally causes only small wave reflections. These may be further tuned out by introducing one or more inductive tuning posts 22 spaced in the axial direction from window slab 19. Posts 22 are of metal, extending across the narrow walls 23 of waveguide 10. Generally best results are obtained from a pair of posts 22 disposed at equal distances on opposite sides of window 19 to make a symmetrical bandpass filter. The size and placing of posts 22 to match out residual reflections is determined by methods and formulae well known in the art. Posts 22 are not necessarily free-standing cylinders, but may have many other shapes, such as lips extending inward from walls 23.

Figure 2:
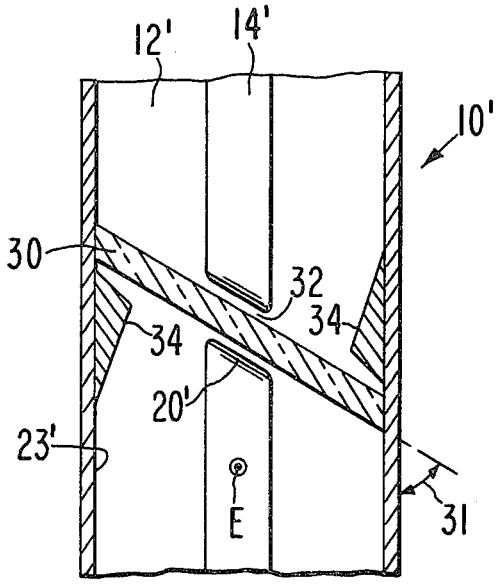
FIG. 2 is a section through the H-plane of a ridged waveguide window assembly with slanted window.

FIG. 2 is an H-plane section of another embodiment of the invention. The sectional view perpendicular to the axis of this embodiment would be almost exactly the same as FIG. 1A, so the section shown in FIG. 2 is indicated on FIG. 1A. In this plane of symmetry all magnetic field lines are in the plane, so it is a true "H-plane". Window 30 is tilted to an angle 31, the tilting angle being in the H-plane such that the axis of tilt is in the direction of the electric field and the surfaces of window 30 are generally parallel to the electric field. This parallelism is advantageous in reducing the chances of a multipactor discharge. Notches 32 in ridges 14' are cut with sides parallel to window slab 30. Slab 30, as before, is hermetically scaled across the waveguide 10' by well-known dielectric-to-metal sealing techniques. Two inductive tuning posts 34 are used, one on either side of window 30, to provide a broadband cancelling of residual wave reflections. Posts 34 in this case are prism-shaped and brazed to the narrow walls 23' of the waveguide hollow interior 12'. Posts 34 may have a wide variety of other shapes. It only matters that they present the correct shunt inductance to the waveguide at the correct axial position.

Figure 3:
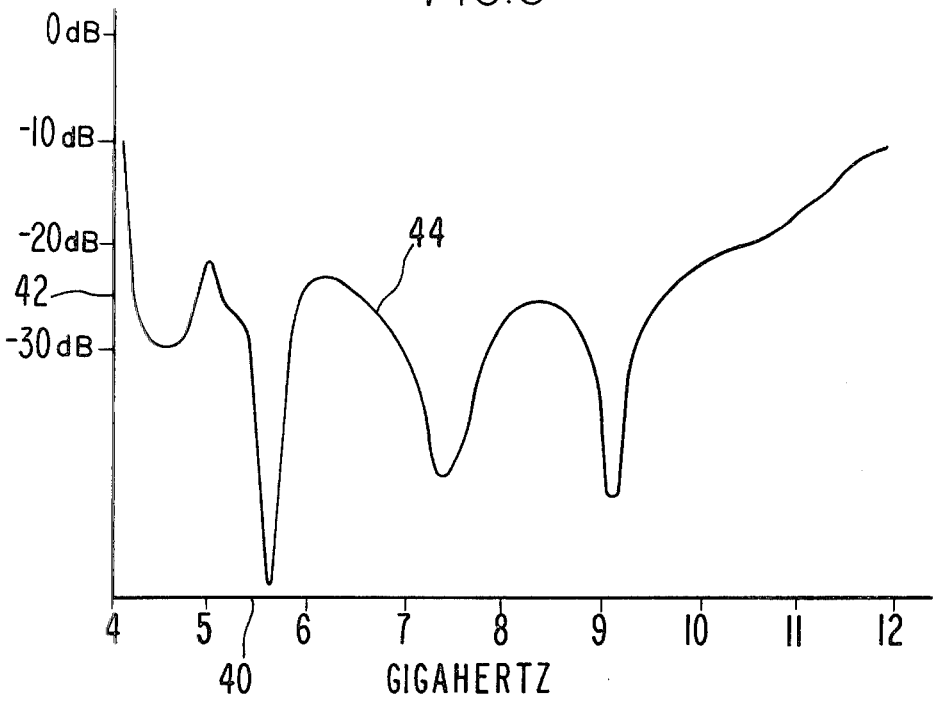
FIG. 3 is a plot of the VSWR of the window of FIG. 1B.

FIG. 3 is a graph of the wave reflection from the transverse window assembly of FIG. 1. The horizontal scale 40 is frequency in gigahertz. The vertical scale 42 is the logarithm in decibels (dB) of the fraction of wave energy reflected by the window assembly. For example, −20 dB means that 1% of the energy is reflected, creating a voltage standing wave ratio of about 1.22:1.

The window assembly is seen to be substantially better than this over the very wide frequency range of about 4 GHz to about 10 GHz.

Figure 4:
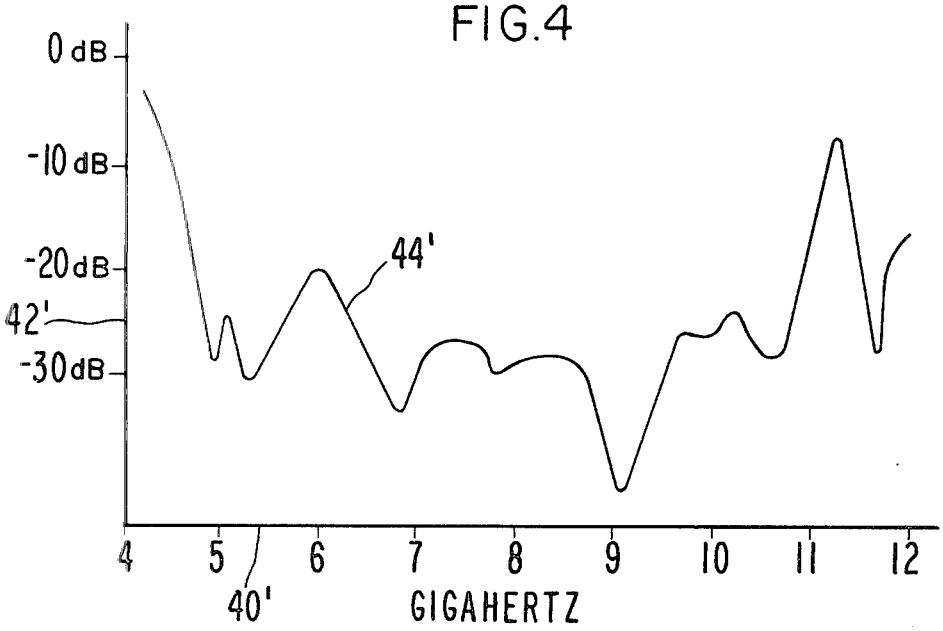
FIG. 4 is a plot of the VSWR of the window of FIG. 2.

FIG. 4 is a graph similar to FIG. 3 but representing the wave reflection from the window assembly of FIG. 2. Again, the match is seen to be excellent over a very wide frequency band.

It is likely that with further experimental work the window assembly of FIG. 2 could be further improved to provide even lower reflections, because the impedance discontinuities are spread out over a substantial length of waveguide. Slanted windows having this advantage are known in the prior art. For example, U.S. Pat. No. 2,894,228 issued July 7, 1959, to W. S. Geisler, Jr., shows a window not slanted parallel to the E-field, but rather almost perpendicular to it. This window covers only a part of the hollow interior of a non-ridged waveguide. U.S. Pat. No. 3,210,699 issued Oct. 5, 1965 to Hisashi Tagano shows a slanted window in a circular waveguide but does not describe the direction of slant with respect to the polarization of the electromagnetic wave.

It will be obvious to those skilled in the art that many variations of my invention can be made without departing from its true scope. The embodiments described above are intended to be illustrative and not limiting. The true scope of the invention is intended to be limited only by the following claims and their legal equivalents.

I claim:

1. A dielectric window assembly for hollow metallic ridged waveguide having an axially elongated ridge defined within an interior wall thereof, comprising:

a notch defined in said ridge axially transversely;

a slab of dielectric sealed across and within a hollow cross-section of said ridged waveguide, said slab having an area at least that of said hollow cross-section of said ridged waveguide, said slab being parallel to the electric field at the center of said waveguide, said slab extending through said notch.

2. The window assembly of claim 1 wherein said waveguide has a pair of juxtaposed ridges, each with a notch through which said slab passes.

3. The window assembly of claim 1 wherein said waveguide defines a longitudinal axis, and said slab is perpendicular to said axis.

4. The window assembly of claim 1 wherein said waveguide defines a longitudinal axis, and said slab is tilted with respect to said axis, about a tilting axis parallel to the electric field at the center of said waveguide.

5. The window assembly of claim 4 wherein said notch has opposing sides parallel to said slab.

6. The window assembly of claim 1 in which said slab area is that of said hollow cross-section, augmented by a cross-sectional area of said ridge.

7. The window assembly of claim 1 in which the thickness of said slab is small compared to the height thereof.

8. In a hollow metallic waveguide for high-power microwave transmission and defining a metallic ridge in the interior wall thereof, said ridge extending substantially throughout said waveguide parallel to the longitudinal axis thereof, the improvement comprising:

a notch in said ridge, said notch extending transversely to said longitudinal axis; and a dielectric window having parallel faces and oriented transversely entirely across and within the interior of said ridged waveguide parallel to the electric field at the center of said waveguide, said window extending at least partially into said notch while otherwise having a peripheral configuration matching that of an interior hollow cross-section of said waveguide.

9. The improvement of claim 8 in which said window has an area which is at least as great as that of said hollow cross-section.

10. The improvement of claim 8 in which said window extends completely into said notch.

11. The improvement of claim 8 in which said notch extends completely through said ridge.

12. The improvement of claim 8 in which said window extends entirely over said hollow cross-section.

13. The window assembly of claim 8 in which the thickness of said window is small compared to the height thereof.

* * * * *